US006525259B2

(12) United States Patent
Sagastegui

(10) Patent No.: US 6,525,259 B2
(45) Date of Patent: Feb. 25, 2003

(54) CADENCE-PROVIDING CONGA DRUM PRACTICE PAD ASSEMBLY AND METHOD

(76) Inventor: John Sagastegui, Educational Music Accessories, 2334 Ave. Marejada, San Clemente, CA (US) 92673

( * ) Notice: Subject to any disclaimer, the term of this patent is extended or adjusted under 35 U.S.C. 154(b) by 0 days.

(21) Appl. No.: 10/032,182

(22) Filed: Dec. 20, 2001

(65) Prior Publication Data

US 2002/0062729 A1 May 30, 2002

Related U.S. Application Data

(63) Continuation of application No. 09/724,741, filed on Nov. 28, 2000.

(51) Int. Cl.[7] ..... G10H 1/02

(52) U.S. Cl. ..... 84/738; 84/104; 84/111; 84/411 R; 84/600; 84/DIG. 12

(58) Field of Search ..... 84/48, 104, 111, 84/411 R, 477 R, 600, 712–714, 737–738, DIG. 12

(56) References Cited

U.S. PATENT DOCUMENTS 3,837,256 A * 9/1974 Gullickson ..... 84/478
4,418,598 A * 12/1983 Klynas ..... 84/DIG. 12
4,479,412 A * 10/1984 Klynas ..... 84/DIG. 12
5,739,457 A * 4/1998 Devecka ..... 84/477 R
5,850,048 A * 12/1998 Ruf ..... 84/477 R
6,018,121 A * 1/2000 Devecka ..... 434/307 A
6,075,197 A * 6/2000 Chan ..... 84/738
6,399,869 B1 * 6/2002 Sagastegui ..... 84/104

* cited by examiner

*Primary Examiner*—Marlon T. Fletcher
(74) *Attorney, Agent, or Firm*—Steins & Associates, P.C.

(57) ABSTRACT

A Cadence-Providing Drum Practice Pad Assembly and Method is disclosed. The preferred assembly combines a practice pad and a cadence generating device in the same body. In other embodiments, the device provides visual prompting to the user on the striking pad. Furthermore, the device of the present invention includes a local repository of cadence programs, as well as the ability to retrieve and play cadence programs stored in remote cadence repositories, such as on a computer network or a portable storage media. In one embodiment the device includes a mounting aperture that is offset from the center of the striking pad so that the pad will have a more realistic feel when mounted to a cymbal stand. Finally, the device may be provided in the form of a conga practice pad.

18 Claims, 12 Drawing Sheets

CADENCE-PROVIDING CONGA DRUM PRACTICE PAD ASSEMBLY AND METHOD

This application is a continuation of application Ser. No. 09/724,741, filed Nov. 28, 2000, now pending.

BACKGROUND OF THE INVENTION

1. Field of the Invention

This invention relates generally to musical percussion instruments and, more specifically, to a Cadence-Providing Drum Practice Pad Assembly and Method 2. Description of Related Art A drum practice pad is commonly used by drummers and students of drumming to assist them in the development or honing of their drumming skills. As shown in FIG. 1, the conventional drum practice pad 10 comprises a flexible mat 12 (made typically from rubber) that is designed to be lain across a table or other flat surface (including a person's lap). Protruding from the top surface of the flexible mat 12 is a striking pad 14. The striking pad 14 typically consists of a hard core, such as from metal or wood, and a covering of the same material as the flexible mat 12.

In using the practice pad 10, the drummer strokes his drum sticks in a constant continuing formation, known as rudiments. These rudiments are stroking exercises which develop the drummer's speed, coordination, timing and technique. When learning to play a particular "drum line" (or drum portion of a piece of music) or rudiment, the drummer first listens to the rudiment or drum line, and then attempts to imitate it on the practice pad 10. This describes an audio learning process (i.e. first hearing a desired act, and then attempting to imitate it); the problem with this strictly audio learning process is that it has been proven to be substantially less effective than visual learning (i.e. first seeing the desired act, and then attempting to imitate it), or a combination of both audio and visual learning processes.

If we now turn to FIG. 2, we can examine another practice device for drummers. FIG. 2 is a perspective view of a conventional electronic drum synthesizer 16. The synthesizer 16 comprises a base 18, upon which are located a plurality of detector pads 20. When the user strikes one of the detector pads 20, the electronics built into the synthesizer 16 will generate a sound from built in speakers 22 (or output the sound signals to headphones or external sound amplification equipment). The synthesizer 16 can be programmed to provide many different sounds in response to the striking of each detector pad 20, and in some models, it can actually play music from its speakers (to which the drummer can play an accompaniment).

The functioning of the conventional synthesizer is depicted as a flow diagram 300 in FIG. 3. As can be seen, the user first strikes a detector pad 302, at which time the detector pad generates and output signal 304. The synthesizer logic (embedded in the electronics package of the synthesizer) receives the output signal from the detector pad 306. The synthesizer logic then converts the detector pad output signal to an audio signal 308. The problem with this device and system is that even though very high quality sounds can be produced, it does not really provide any additional benefit over the practice pad to the drummer in practicing or learning rudiments, since it too employs an audio learning process. What is needed is a drum practice system and method that employs visual learning techniques.

SUMMARY OF THE INVENTION

In light of the aforementioned problems associated with the prior devices and methods, it is an object of the present invention to provide a Cadence-Providing Drum Practice Pad Assembly and Method. The preferred assembly will combine a practice pad and a cadence generating device in the same body. It is an object that other embodiments provide visual prompting to the user on the striking pad. It is yet another object that the device of the present invention include a local repository of cadence programs, as well as the ability to retrieve and play cadence programs stored in remote cadence repositories, such as on a computer network or a portable storage media. It is a further object that the device include a mounting aperture that is offset from the center of the striking pad so that the pad will have a more realistic feel. It is yet a further object that the device be provided in the form of a conga practice pad.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the ant, since the generic principles of the present invention have been defined herein specifically to provide a Cadence-Providing Drum Practice Pad Assembly and Method.

Figure 1:
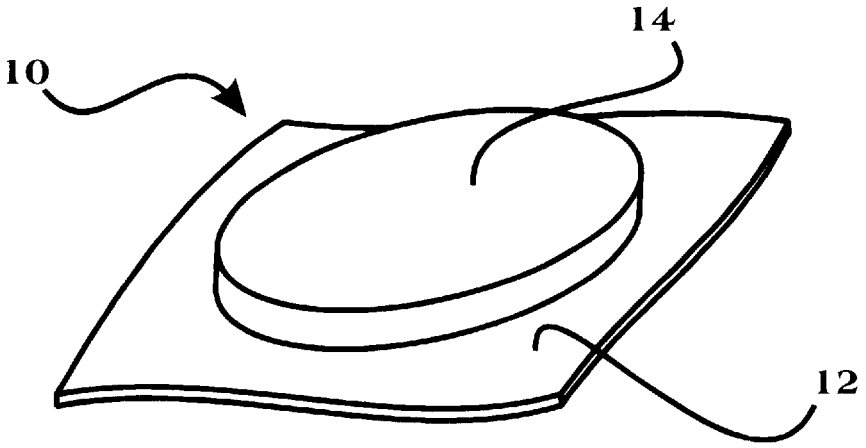
FIGURE 1 PRIOR ART
FIG. 1 is a perspective view of a conventional drum practice pad.
Figure 2:
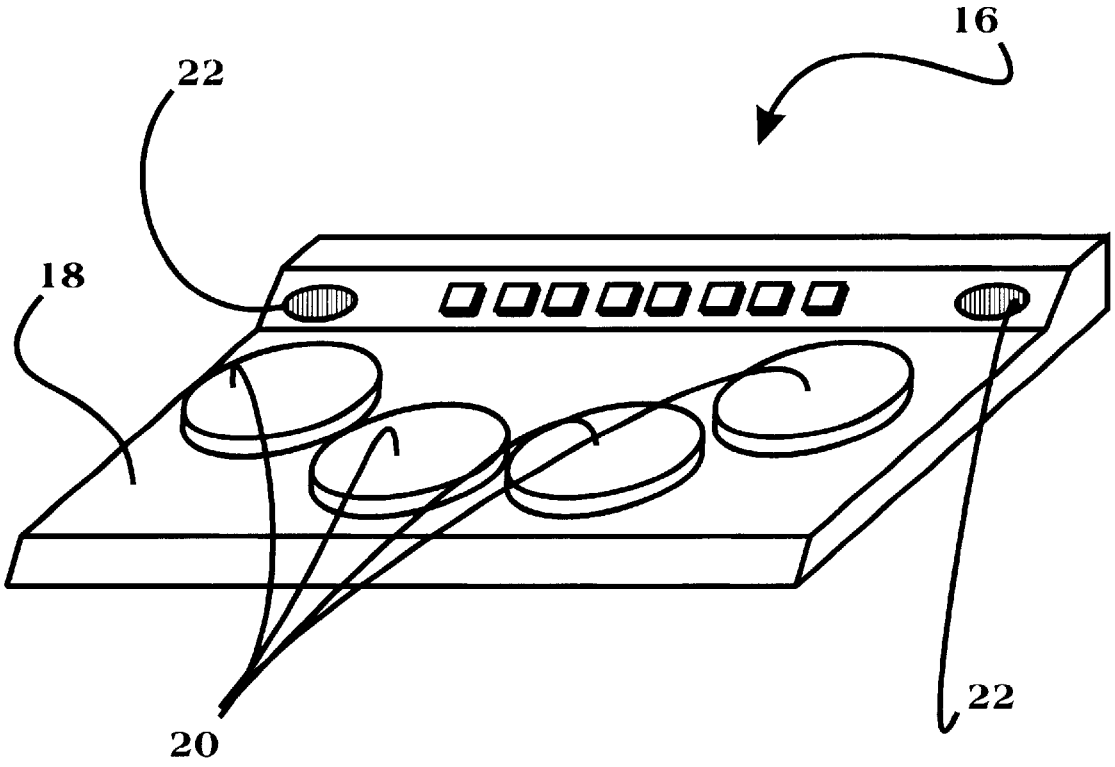
FIGURE 2 PRIOR ART
FIG. 2 is a perspective view of a conventional electronic drum synthesizer.
Figure 3:
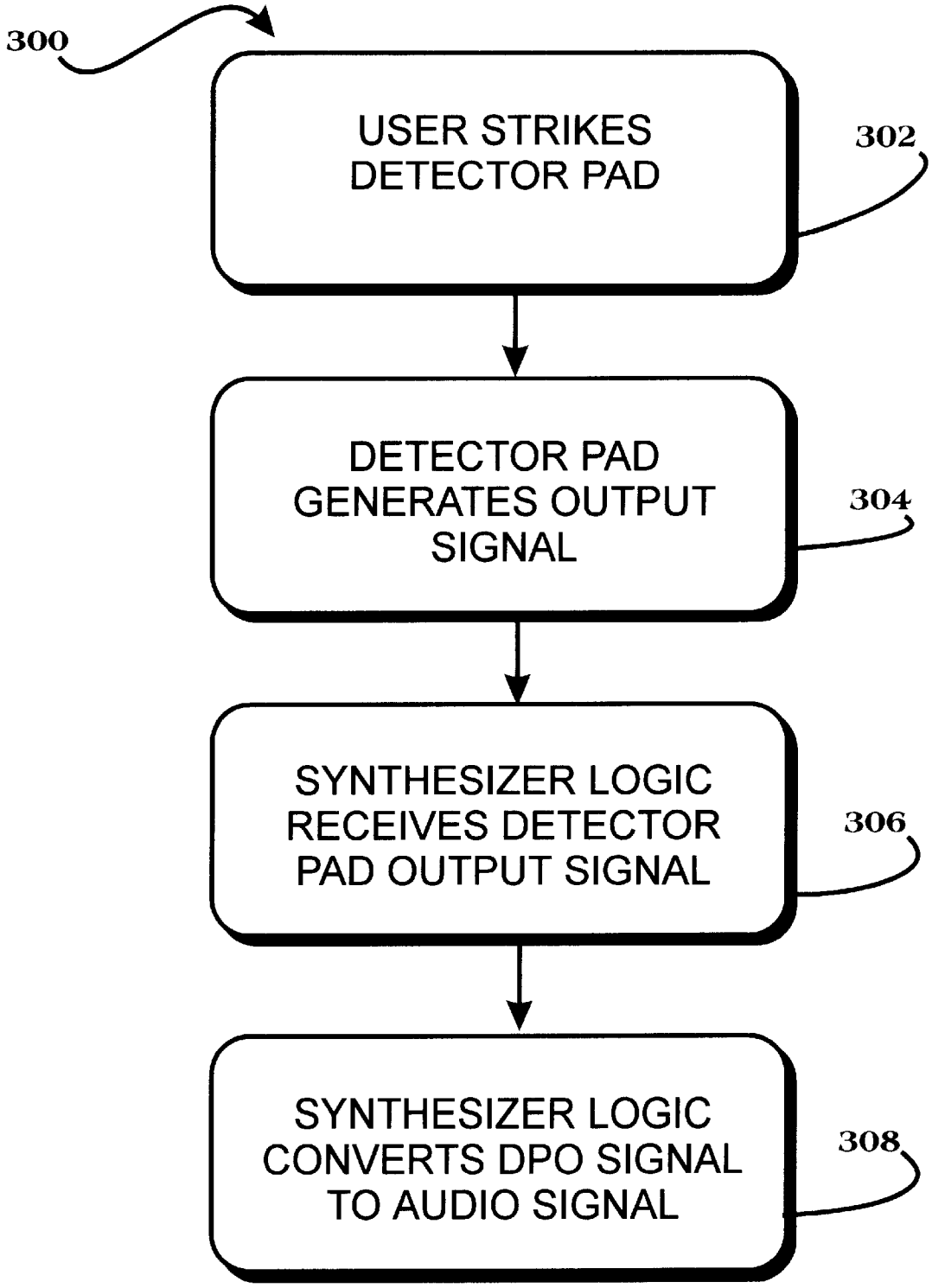
FIGURE 3 PRIOR ART
FIG. 3 depicts the operating process for a conventional drum synthesizer.
Figure 4:
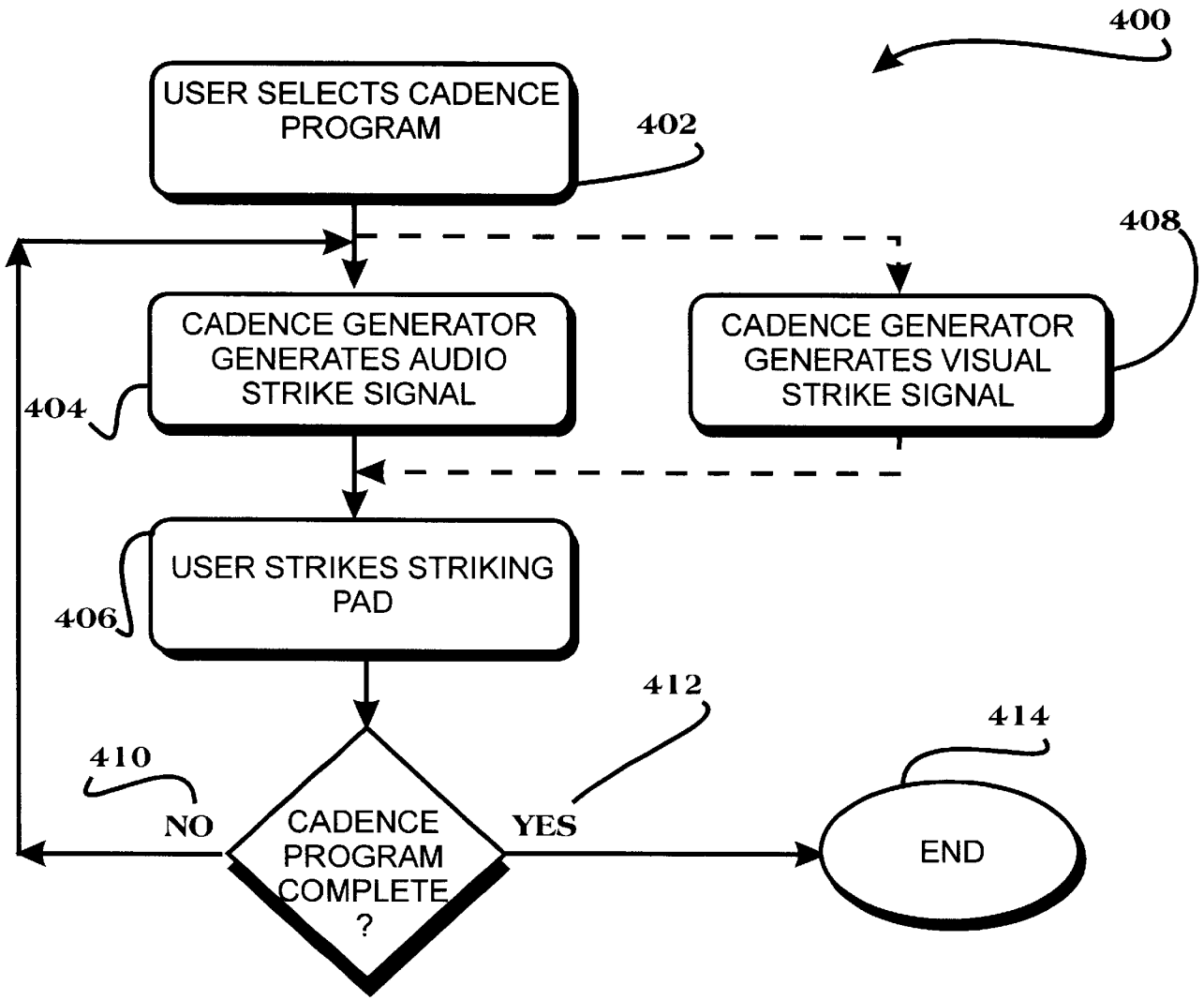
FIG. 4 depicts the operating method of the invention of the present invention.

The present invention can best be understood by initial consideration of FIG. 4. FIG. 4 depicts the operating method 400 of the invention of the present invention. Unlike the conventional practice pads and other devices described hereinabove, the present method commences with the user selecting a cadence program 402. The cadence program is selected from a repository of cadence programs, each resulting in a different combination of rudimentary drum strikes. Once the cadence program is selected by the user, the cadence generator (for example a "metronome") generates an audio strike signal 404 that is audibly perceptible to the human senses. In response to this audio signal, the user strikes a striking pad 406. Unlike the prior methods, then, in the present invention, the user strikes a pad in response to a single audio signal (rather than the user listening to a string of audio signals and then trying to imitate the entire string). Furthermore, it is an optional feature that the cadence generator generate a visual strike signal 408, coincidental with the audio strike signal, that is visually perceptible to the human senses.

If the cadence program has not been completed (or the system has not been manually stopped), 410, then the next audio/visual strike signal is generated. When the cadence program is completed (or the system is manually stopped) 412, then the system ends this routine 414, and the presentation of strike signals ceases. Now turning to FIG. 5, we can begin to examine the structure of the present invention.

Figure 5:
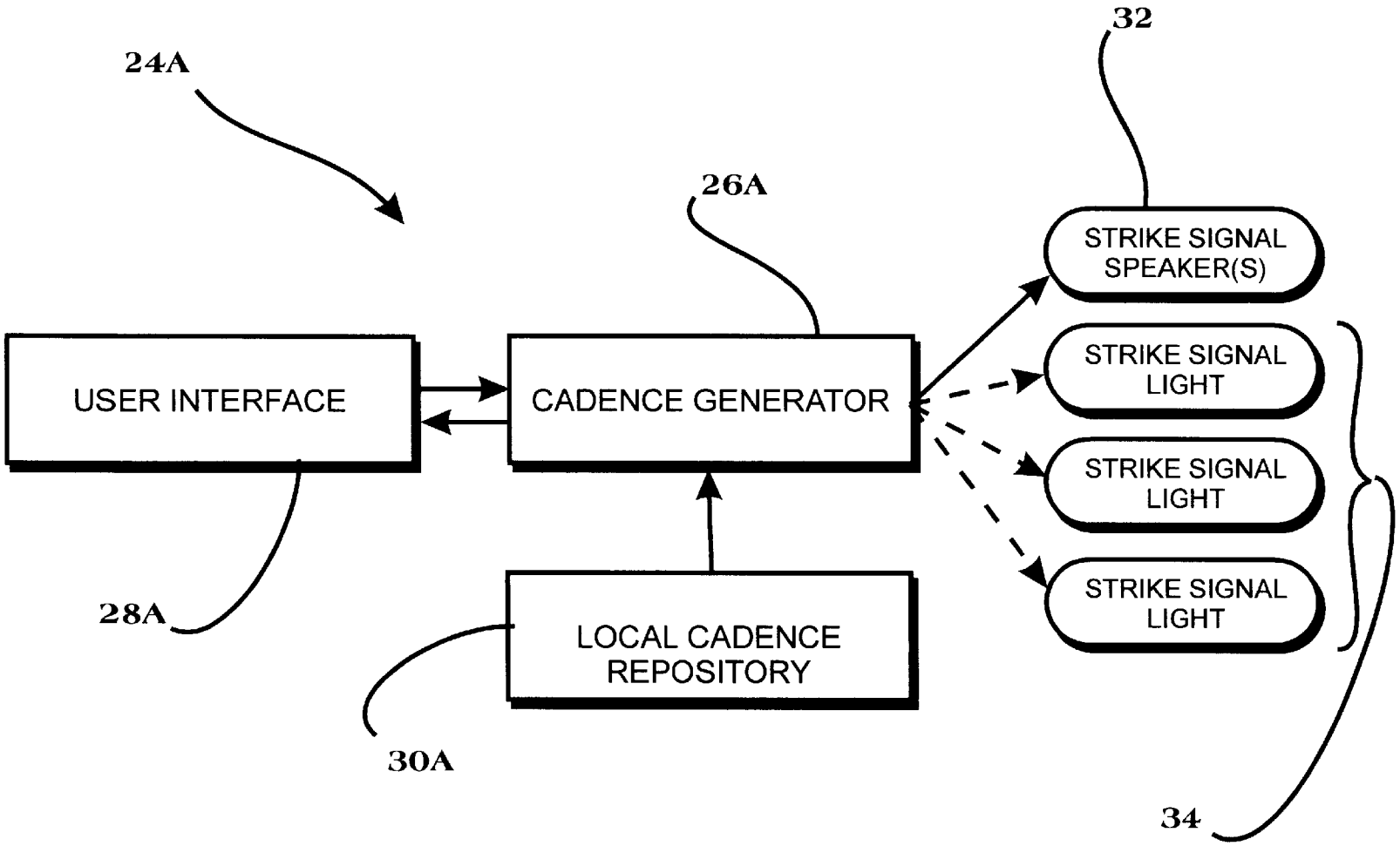
FIG. 5 depicts the functional arrangement of the components of a preferred embodiment of the Cadence-providing drum practice pad assembly of the present invention.

FIG. 5 depicts the functional arrangement of the components of a preferred embodiment of the Cadence-providing drum practice pad assembly 24A of the present invention. As shown in this functional diagram, the cadence generator 26A is controlled by a user interface 28A (which may actually be incorporated within the cadence generator logic), to permit the user to select a particular cadence program from a local cadence repository 30A. Once selected the cadence program is operated upon by the cadence generator 26A to provide audio sounds from one or more strike signal speakers 32, and possibly to provide visual sounds from one or more strike signal visual indicators 34. As discussed above in connection with FIG. 4, the user is then expected to repeat each strike as prompted by the audio and visual signals. There are several embodiments of the present invention, another of which is shown in FIG. 6.

Figure 6:
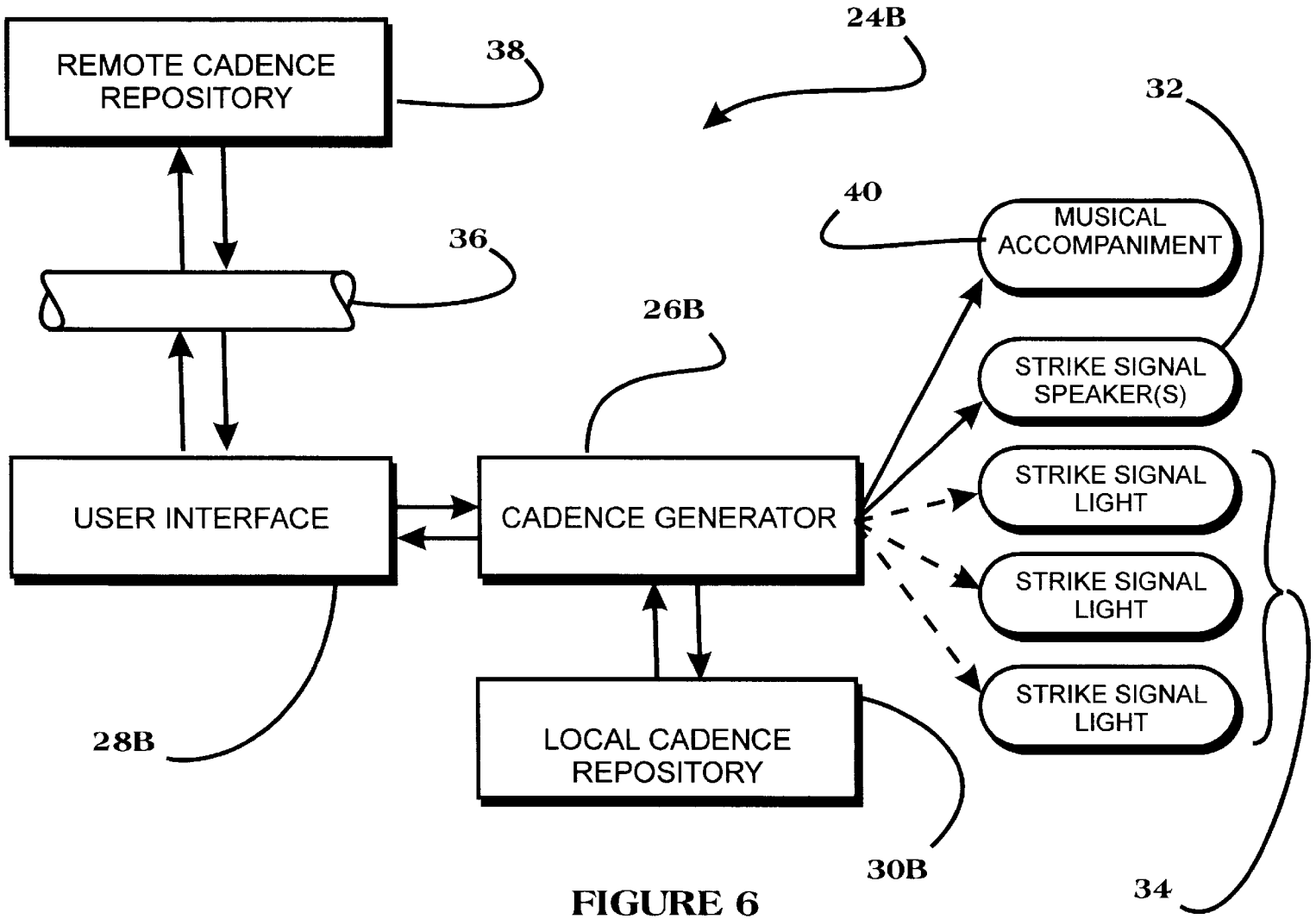
FIG. 6 depicts the functional arrangement of the components of an alternate embodiment of the Cadence-providing drum practice pad assembly of the present invention.

FIG. 6 depicts the functional arrangement of the components of an alternate embodiment of the Cadence-providing drum practice pad assembly 24B of the present invention. In this embodiment, the cadence generator 26B is controllable by the user interface 28B to potentially communicate with a remote cadence repository 38 via a network conduit 36 (e.g. the world-wide-web) to permit the user to obtain a wider variety of cadence programs. Cadence programs retrieved from the remote cadence repository 38 can then be stored in the local cadence repository 30B (for later presentation by the cadence generator), or might be operated upon immediately by the cadence generator 26B.

In this embodiment, not only can the cadence generator drive strike signal speakers 32 and strike signal visual indicators 34, but it may also provide musical accompaniment for the user through musical accompaniment speakers 40 (which might be the same device(s) as the strike signal speakers 32), or it might be sent to external output, similar to the conventional drum synthesizer. What should be understood is that the assembly 24B of this embodiment has the ability to accept cadence programs from external sources (even from a portable storage media, such as a "floppy disc"), and then execute these cadence programs to output through the speaker(s) and/or visual indicator(s). To understand the physical structure of the present invention, we shall now turn to FIG. 7.

Figure 7:
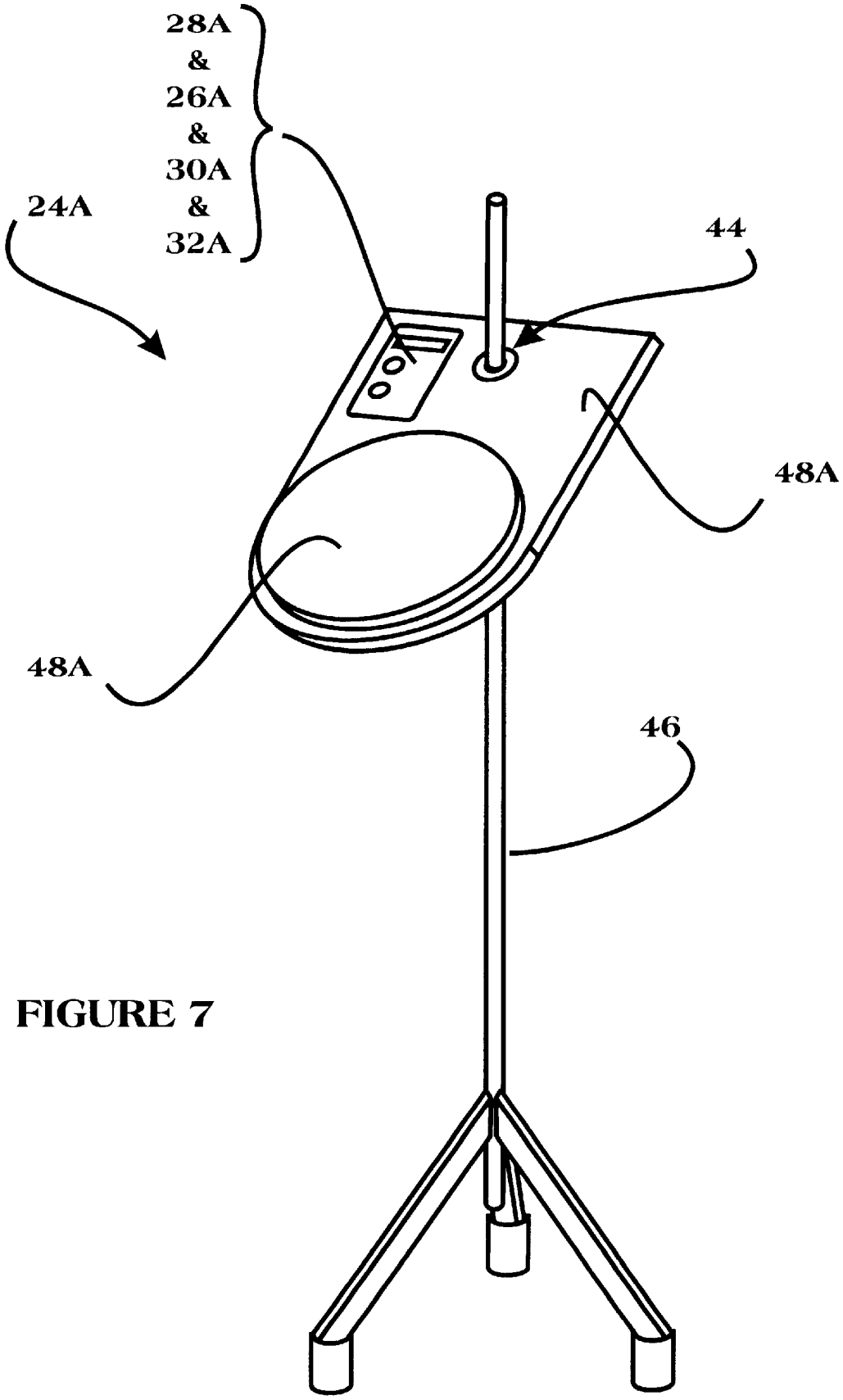
FIG. 7 is a perspective view of a preferred embodiment of the assembly of FIG. 5.

FIG. 7 is a perspective view of a preferred embodiment of the assembly 24A of FIG. 5. As shown, the assembly 24A comprises a base 42A, which is preferably formed with an aperture 44 therein for attachment to (or perching on) an external structure, such as the cymbal stand 46 shown (the user may alternatively choose to attach the assembly 24A to an actual drum stand). In this embodiment, a striking pad 48A is attached or formed on the base 42A to provide the user with a cushioned surface upon which he or she can strike their drum sticks. Also included in this embodiment is a single device that makes up the user interface 28A, the cadence generator 26A, the local cadence repository 30A and at least one strike signal speaker 32A. This assembly 24A is used as described herein above, namely, the user selects a cadence program from the cadence repository 30A, and sets the cadence generator 26A to present the desired cadence to the user for practice/training. If we turn to FIG. 8, we can examine yet another embodiment of the present invention.

Figure 8:
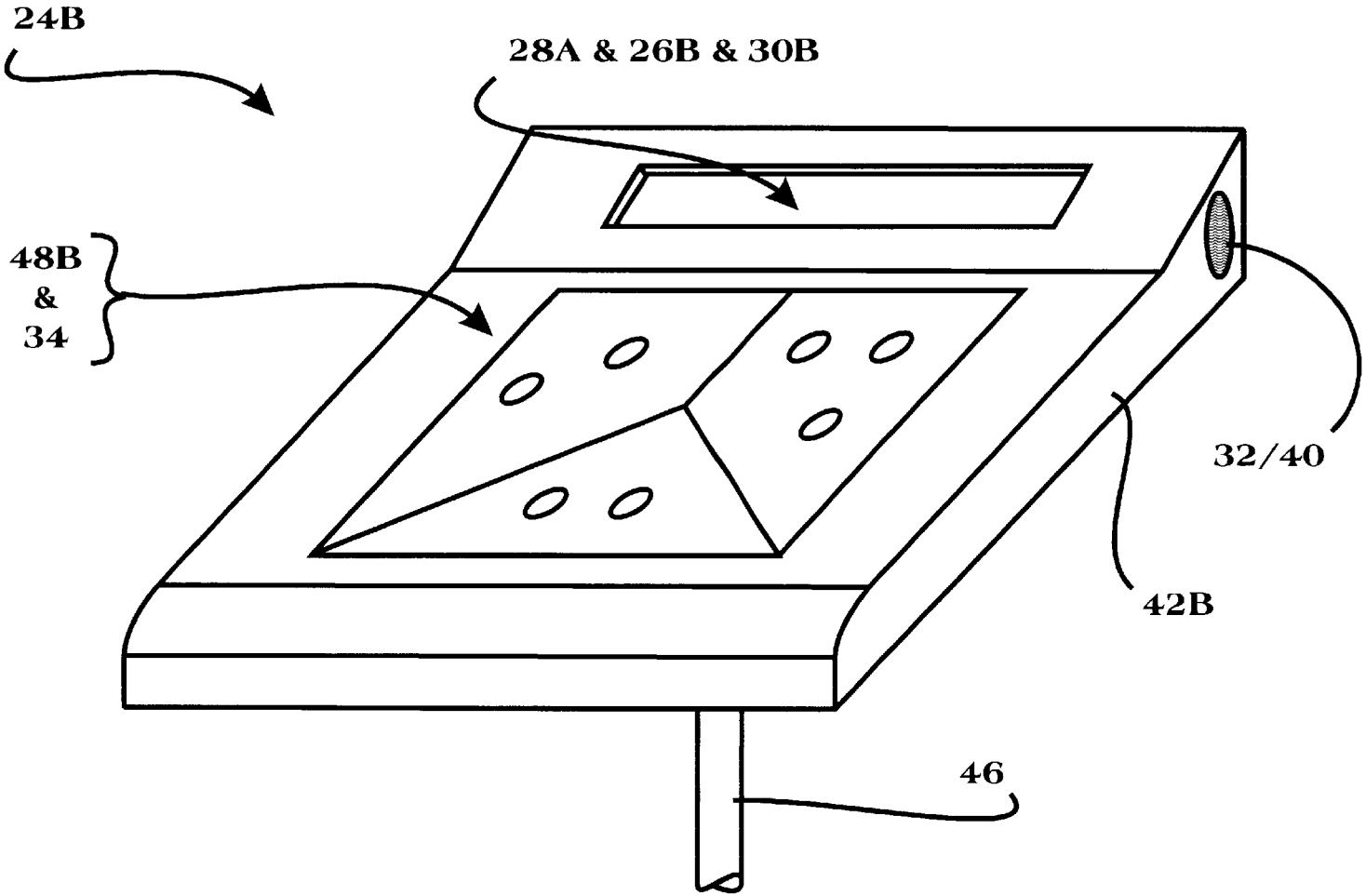
FIG. 8 is a perspective view of a preferred embodiment of the assembly of FIG. 6.

FIG. 8 is a perspective view of a preferred embodiment of the assembly 24B of FIG. 6. In this embodiment, the base 42B houses the electronics necessary to provide the functionality described above in connection with FIG. 6. Protruding from, (or flush with as shown here) the base 42B is the striking pad 48B; more detail related to the striking pad 48B is shown below in connection with FIGS. 9 and 10, however it is pointed out here that disbursed on the striking pad 48B is one or more of the strike signal visual indicators 34 that were discussed above. When the cadence generator 26B presents a cadence to the user, and when the visual indicators 34 are employed, it should be appreciated that the different visual indicators disbursed on the face of the striking pad 48B can be selectively illuminated by the cadence generator to provide the user with specific, visual direction as to when and where to make his or her drum stick strike. This has been demonstrated to provide the user with a very powerful learning tool that uses the visual learning process (in addition to audio learning).

Other details shown in this FIG. 8 include the combined strike signal speaker 32 and musical accompaniment speaker 40; it should be understood that not every user or every training session will involve the user's playing of accompaniment music—should such music be desired, however, then the user can have it played by the assembly 24B. It should further be noted that this embodiment of the assembly 24B might also include an aperture formed in its base 42B in order to provide a means for perching it upon a cymbal stand 46.

Figure 9:
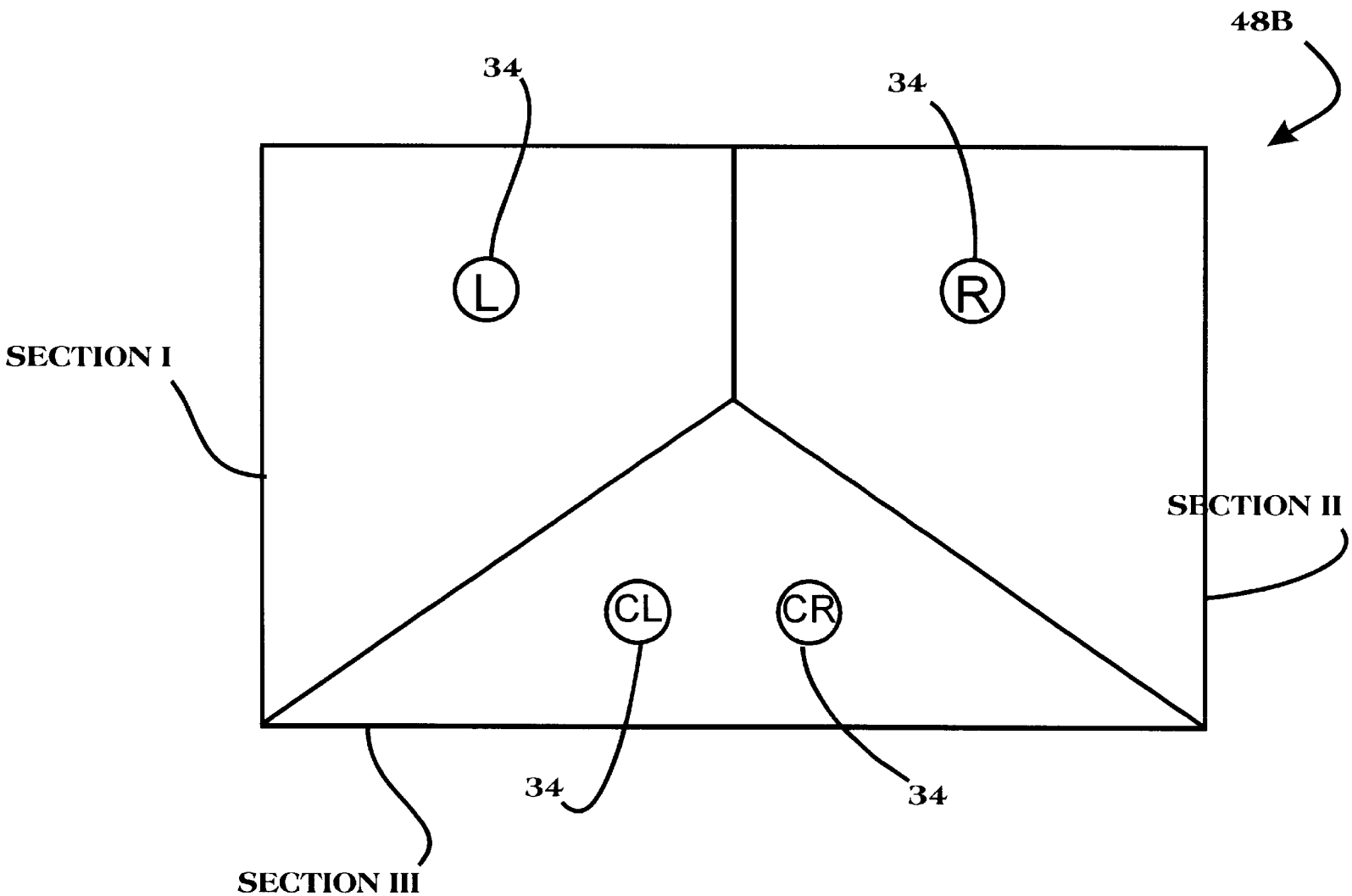
FIG. 9 is a top view of a preferred embodiment of a striking pad of the embodiment of the assembly of FIGS. 6 and 8.

FIG. 9 is a top view of a preferred embodiment of a striking pad 48B of the embodiment of FIGS. 6 and 8. As shown, the striking pad 48B is divided up into three sections (Sections I, II and III); these sections may have different colors, for example Section I being green, Section II being blue, and Section III being red. Disbursed across the Sections are a plurality of strike signal visual indicators 34; these are preferably labeled as shown to indicate what sound might be coincidentally produced by the strike signal speaker. A further advancement related to the device of FIG. 7 is discussed in connection with FIG. 10.

Figure 10:
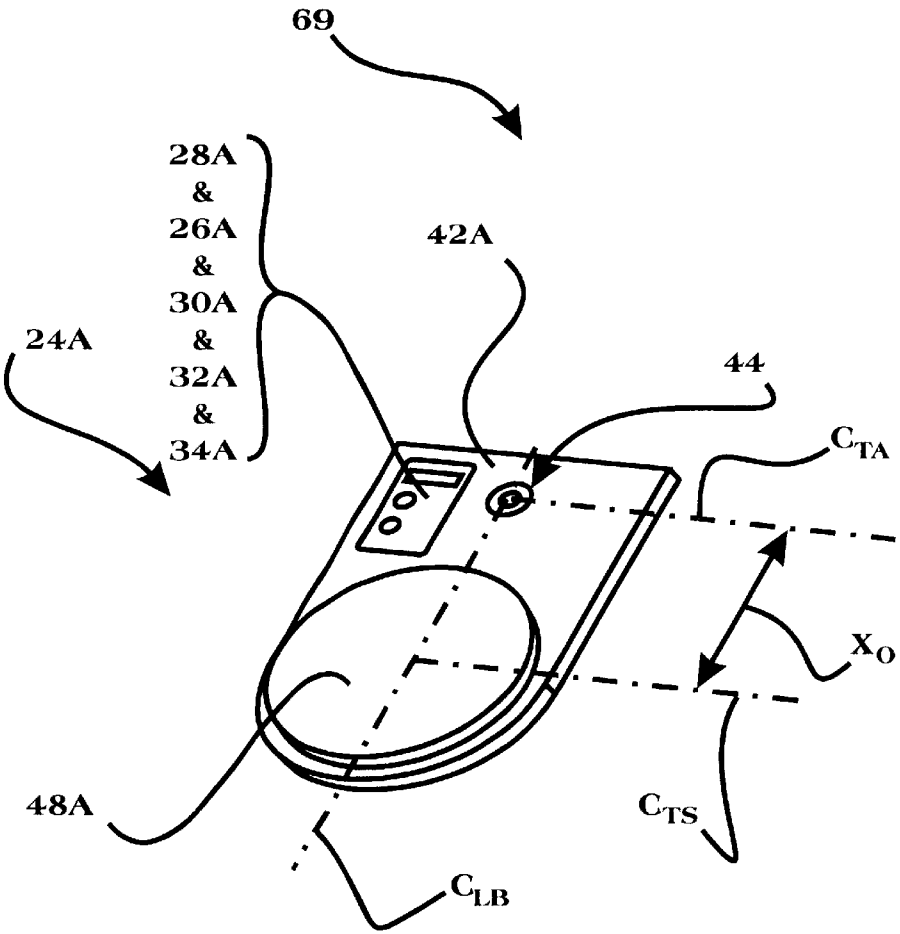
FIG. 10 is a perspective view of the embodiment of FIG. 7.

FIG. 10 is a perspective view of the embodiment 24A of FIG. 7. In order to simplify the discussion, the devices 28A, 26A, 30A, 32A and 34A will be collectively referred to as the cadence generating assembly 69. The device of this embodiment includes a further novel aspect that was depicted but not specifically discussed above in connection with FIG. 7, namely, another way of improving the feel of the device 24A. As we look at the Device 24A, we can see that the striking pad 48A is substantially centered on the longitudinal centerline of the base 42A (labeled as $C_{LB}$). The striking pad 48A further defines a transverse centerline (labeled as $C_{TS}$). Furthermore, the aperture 44 formed in the base 48A for accepting a cymbal stand therethrough (see FIG. 7), also defines a transverse centerline (labeled as $C_{TA}$). What is unique about this design 24A is that there is an offset distance $X_O$ between the two centerlines $C_{TA}$ and $C_{TS}$; this offset distance $X_O$ results in the device 24A extending at a cantilevered angle from the stand (see FIG. 7). Because the mounting point (i.e. the aperture) is not aligned with the center of the striking pad 48A, the device 24A exhibits a rebounding reaction when it is struck. The result of this rebound is a desirable more natural, drum-like feel that has not heretofore been taught. If we now turn to FIG. 11, we can begin to discuss yet another embodiment of the present invention.

Figure 11:
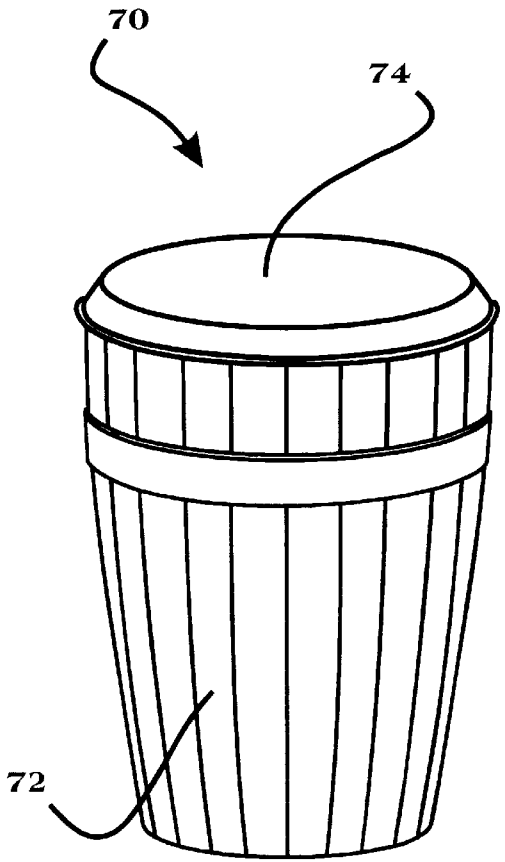
FIGURE 11 PRIOR ART
FIG. 11 is a perspective view of a prior art conga drum.
Figure 12:
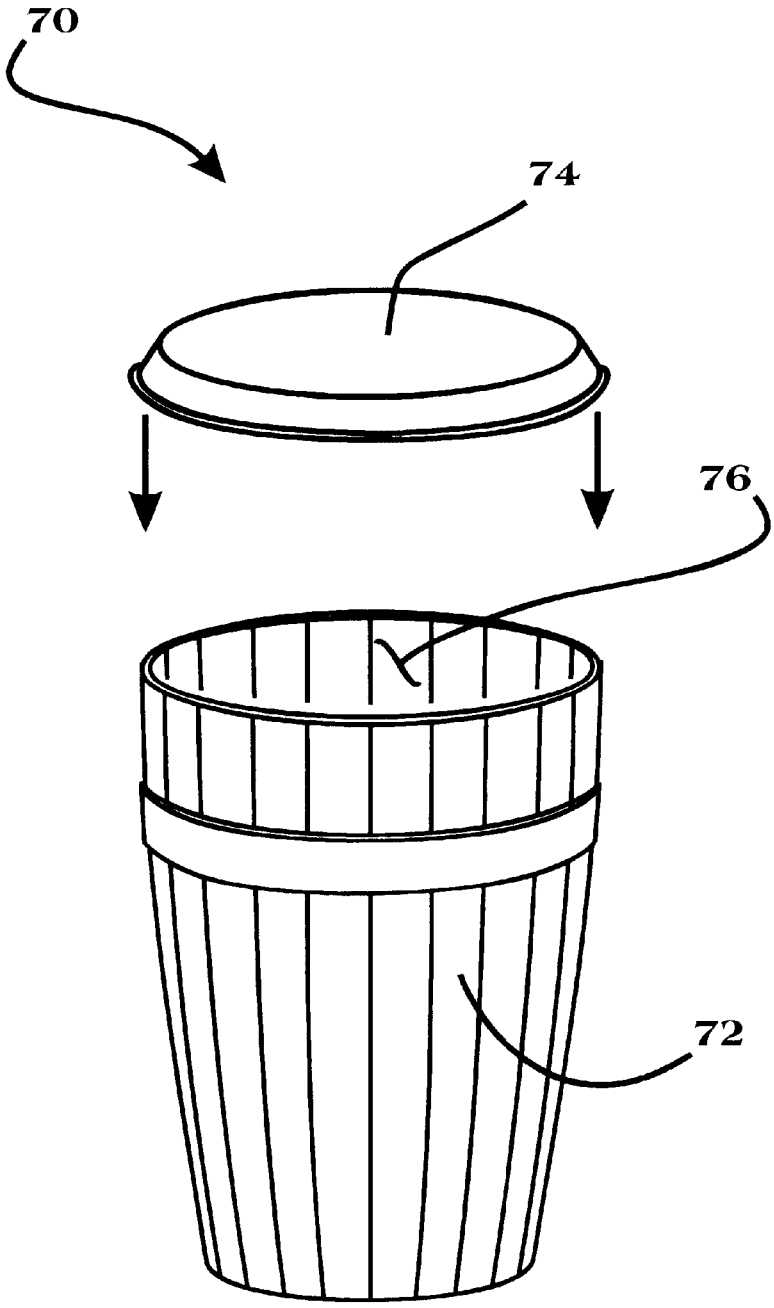
FIGURE 12 PRIOR ART
FIG. 12 is a partially exploded perspective view of the prior conga drum of FIG. 11.

FIG. 11 is a perspective view of a prior art conga drum 70. While available in various sizes and styles, each design typically comprises a hollow body 72, to which a natural or synthetic skin-type drum head 74 is attached. While conga drums have been available for many, many years, there has never before been a product that enables a student or practitioner to practice conga playing; the large size of the typical conga drum, therefore made learning the conga somewhat challenging. As shown in FIG. 12, the reason for the large size of the conga drum 70 is the need for the large inner chamber 76 in order to create the unique conga sound. If the sound is not desired, however, the inner chamber 76 can be eliminated in favor of a small compact size and virtually no drum sound, while still providing a realistic-feeling practice pad. If we turn, now, to FIG. 13, we can examine the first embodiment of this unique device.

Figure 13:
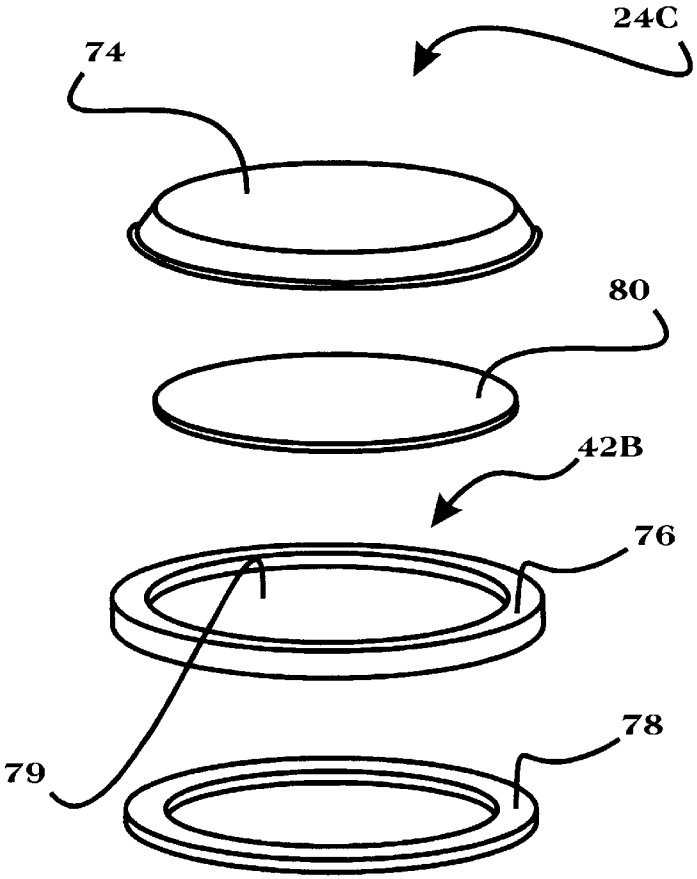
FIG. 13 is an exploded perspective view of an alternate embodiment of the a non-cadence-producing assembly of the present invention.

FIG. 13 is an exploded perspective view of an alternate embodiment of the a non-cadence-producing assembly 24C of the present invention. As shown here, a conventional drum head 74 is attached to a base 42B. The base 42B is defined by a raised ridge 76 around its periphery, and a substantially flat bottom member 79. A cushioning pad 80 is sandwiched between the base 42B and the head 74, to provide a very conga-like feel and rebound to the user's hands. In order to provide a stable device for tabletop (or other) use, the device 24C may be provided with a non-skid pad 78 on the bottom surface of the base 42B. While this drawing figure does not depict the cadence generating assembly (see FIG. 10), there may be one provided as an integral part of the device 24C, such as one that is viewable when looking up at the bottom of the base 42B. Alternatively, the device may be provided as shown in FIG. 14.

Figure 14:
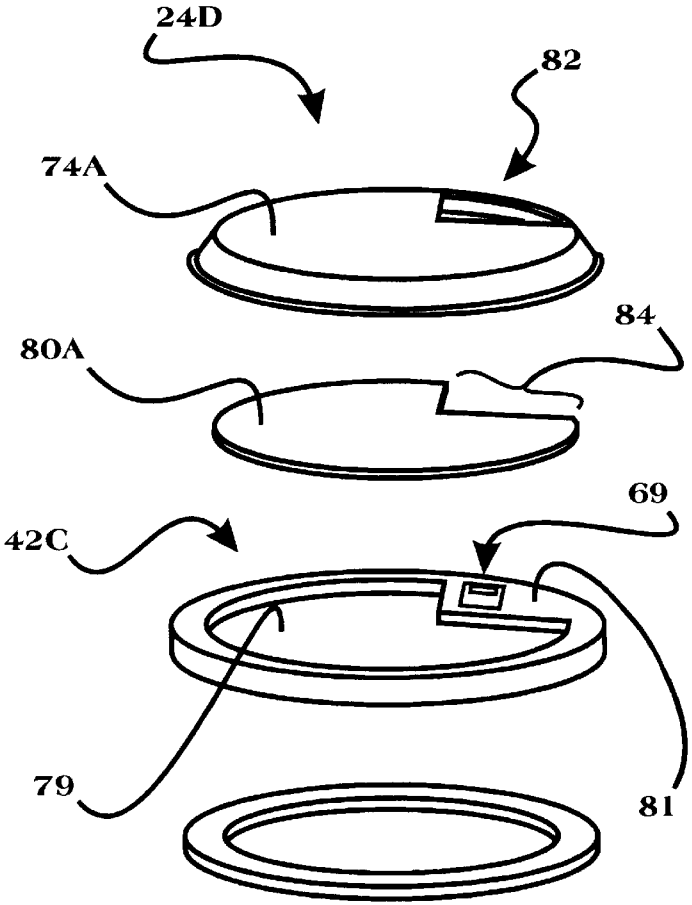
FIG. 14 is an exploded perspective view of an alternate embodiment of a cadence-producing assembly of the present invention.

FIG. 14 is an exploded perspective view of an alternate embodiment of a cadence-producing assembly of the present invention 24D. As shown here, a raised platform 81 is provided on the base 42C; a cadence generating assembly 69 is located on the platform 81 for ease of use by the user. As shown, this embodiment 24D incorporates an alternate cushioning pad 80A, where a notch 84 is formed therein to cooperate with the platform 81 (and cadence generating assembly 69). Additionally, the drum head 74A has an aperture 82 formed therein that is shaped cooperatively with the notch 84 and platform 81, such that the cadence generating assembly 69 is viewable through the head 74A (in the assembled pad 24D). It should be understood that while an aperture is shown to be formed in the head 74A, other designs might include the use of a translucent or transparent material in the vicinity of the cadence generating assembly 69 (or even for the entire head 74A); in any design, the cadence generating assembly 69 would be viewable from the top of the device 24D. The assembled pad 24D is shown next in FIG. 15.

Figure 15:
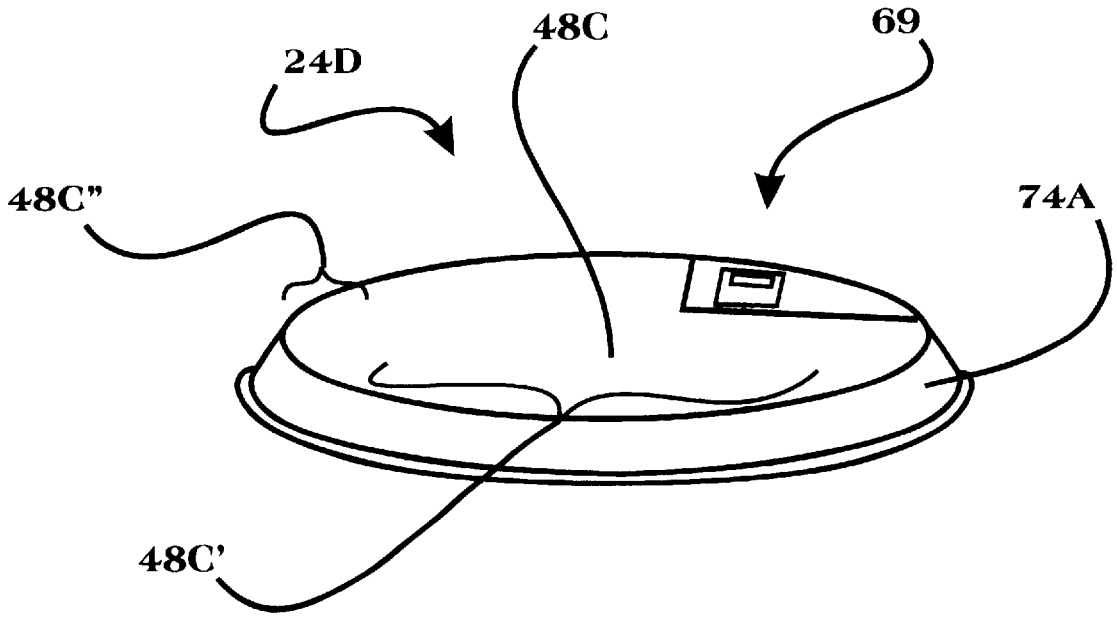
FIG. 15 is a perspective view of the assembly of FIG. 14.

FIG. 15 is a perspective view of the assembly 24D of FIG. 14. When assembled, the device 24D defines a striking pad 48C on the drum head 74A. In addition to the center striking pad zone 48C', it should be appreciated that the ridge (see FIGS. 13 and 14) formed around the periphery of the base, and without any cushioning between it and the head 74A creates a ridge striking pad zone 48C' that accurately approximates the feel of the same zone on a conventional conga drum (see FIGS. 11 and 12). The result is a device that feels like a conga drum both in the center striking zone 48C' and the ridge striking zone 48C". If we finally turn to FIG. 16, we can review still more novel aspects of the present invention.

Figure 16:
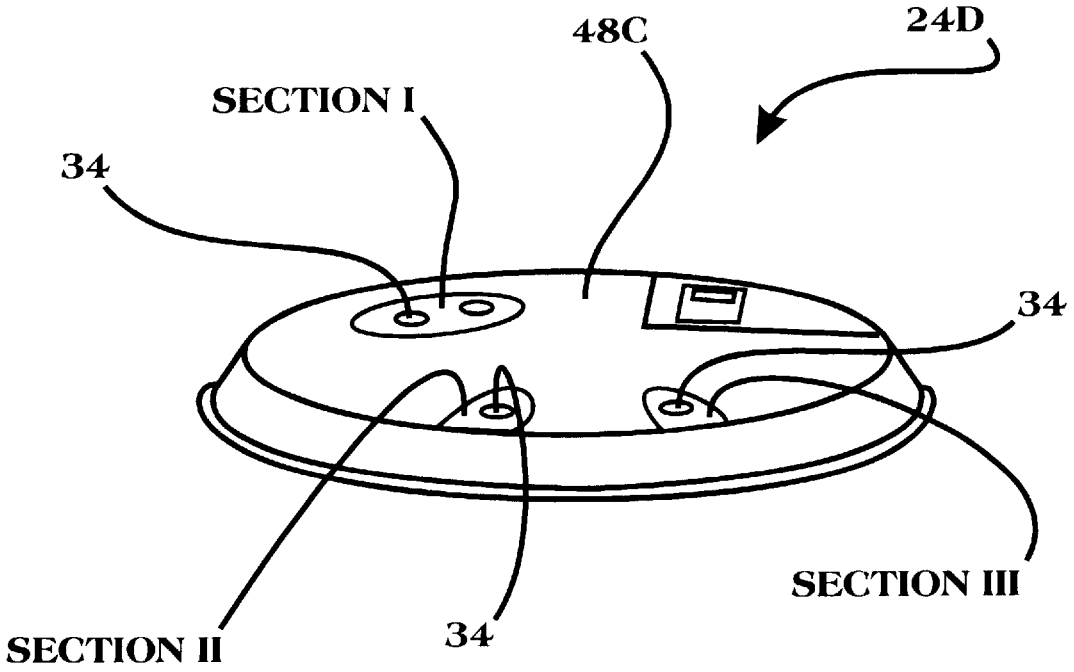
FIG. 16 is a perspective view of the assembly of FIGS. 14 and 15, further depicting striking sections disposed on the striking surface.

FIG. 16 is a perspective view of the assembly of FIGS. 14 and 15, further depicting striking sections disposed on the striking surface 48C. As shown here, the striking pad 48C has three sections disbursed on its surface. These Sections I–III are provided to assist the pupil in learning where the optimum striking location is. The different sections may each be provided in different colors in order that they might be easily and specifically referred to. Furthermore, the device 24D may have one or more visual strike signal indicators 34 located within one or more of the sections. In this manner, the visual strike signal indicators 34 can provide visual prompting for where and when the user should strike the pad 48C.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A cadence-providing drum practice pad assembly, comprising:

a cadence generator;

at least one strike signal speaker means for generating audible strike signals responsive to said cadence generator;

at least one striking pad;

at least one strike signal visual indicator means in communication with said cadence generator, said strike signal visual indicator means for generating visible strike signals responsive to said cadence generator;

said practice pad further comprises a base including aid cadence generator, said strike signal speaker means and each said striking pad, said base defining a longitudinal centerline, said striking pad defining a center, said center being aligned with said longitudinal centerline, said striking pad further defining a transverse centerline perpendicular to said longitudinal centerline; and a mounting aperture formed through said base, said aperture defining a center, said center being aligned with said longitudinal centerline, said aperture further defining a transverse centerline perpendicular to said longitudinal centerline, said aperture center and said string pad center dependently disbursed to provide a distance greater than zero between said striking pad transverse centerline and said aperture transverse centerline.

2. The assembly of claim 1, further comprising:

a base, said base defining a substantially circular outer periphery, a bottom member and a ridge protruding upwardly from said bottom member around said outer periphery.

3. The assembly of claim 2, wherein:

said ridge and said bottom member form a central recessed portion; and further comprising a cushioning pad located in said recessed portion.

4. The assembly of claim 3, further comprising a drum head attached to said base and said cushioning pad.

5. The assembly of claim 4, wherein:

said base further defines a bottom surface; and said assembly further comprises a non-skid pad attached to said bottom surface.

6. The assembly of claim 2, wherein:

said assembly further comprises a cadence-providing assembly, said cadence-providing assembly comprising said cadence generator, said strike signal visual indicator means and said strike signal speaker means, said cadence-providing assembly attached to said base; and said drum head further comprises an aperture formed therein for viewing said cadence-providing assembly therethrough.

7. The assembly of claim 6, wherein said cushioning pad further comprises a notch formed therein for cooperating with said drum head aperture and said cadence-providing assembly to permit said cadence-providing assembly to be viewed through said drum head aperture.

8. The assembly of claim 7, wherein:

said striking pad is located on said drum head; and further comprising at least one said strike signal visual indicator means disbursed on said striking pad.

9. The assembly of claim 8, wherein:

said assembly further defines at least one striking section disbursed on said drum head, each said striking section comprising at least one said strike signal visual indicator means.

10. The assembly of claim 9, comprising three said striking sections disbursed on said drum head.

11. The assembly of claim 10, further comprising:

user interface means for enabling a user to operate said cadence generator; and a local cadence repository operatively connected to said cadence generator and said user interface means, said local cadence repository storing alternate cadence programs for selection by a user for execution by said cadence generator.

12. The assembly of claim 11, wherein, each section displays a color that differs from the other said sections.

13. The assembly of claim 12, wherein said striking surface comprises a blue-colored section, a red-colored section and a green-colored section.

14. The assembly of claim 13, wherein said striking pad comprises a translucent striking surface through which each said strike signal means is visible, said striking surface further comprising a blue-colored section, a red-colored section, and a green-colored section.

15. The assembly of claim 11, further comprising:

network conduit connection means for permitting said assembly to communicate via a computer network;

a remote cadence repository operatively connectable with said user interface via said network conduit connection means, said remote cadence repository storing alternate cadence programs for selection by a user for saving in said local cadence repository or for selection by a user for execution by said cadence generator.

16. The assembly of claim 15 further comprising musical accompaniment speaker means for generating audible accompanying music for a user's enjoyment.

17. The assembly of claim 1, wherein:

each said striking pad is defined by a periphery; and each strike signal visual indicator means is visible in proximity to said periphery of said striking pad.

18. The assembly of claim 1, wherein:

said striking pad defines a surface, said pad further being generally circular in shape and defines a first-colored portion covering substantially one-half of said surface, further defines a second-colored portion covering substantially one-quarter of said source, and further defines a third-colored surface covering substantially one-quarter of said surface.

* * * * *